United States Patent [19]

Heroux

[11] 4,089,141

[45] May 16, 1978

[54] APPLICATION OF SIDING, SHINGLES OR SHAKES TO A WALL STRUCTURE

[76] Inventor: George Armand Heroux, 617 Douglas Ave., Prescott, Ariz. 86301

[21] Appl. No.: 746,583

[22] Filed: Dec. 1, 1976

[51] Int. Cl.[2] ..... E04B 1/00; E04D 1/34

[52] U.S. Cl. ..... 52/105; 52/547; 52/127; 52/DIG. 1; 52/748; 269/102

[58] Field of Search ..... 52/741, 748, 749, 105, 52/127, 547, 714, DIG. 1; 269/94, 102, 321 S, 321 W

[56] References Cited

U.S. PATENT DOCUMENTS

| | | | |
|---|---|---|---|
| 451,572 | 5/1891 | Rankin, Jr. | 52/547 X |
| 1,510,497 | 10/1924 | Keller | 52/547 |
| 1,538,329 | 5/1925 | Honigbaum | 52/547 |
| 1,556,649 | 10/1925 | Topping | 52/105 |
| 1,775,937 | 9/1930 | Keller | 52/547 |
| 2,216,271 | 10/1940 | Joiner | 52/547 X |
| 2,511,083 | 6/1950 | Small | 52/547 |
| 2,528,211 | 10/1950 | Civkin et al. | 52/105 X |
| 3,327,446 | 6/1967 | Tracy | 52/547 |
| 3,904,184 | 9/1975 | Krueger | 52/DIG. 1 X |

*Primary Examiner*—Alfred C. Perham
*Assistant Examiner*—Robert C. Farber
*Attorney, Agent, or Firm*—William P. Green

[57] ABSTRACT

Siding boards, shingles, shakes, or the like are applied to the wall of a building by use of a tool having an arm which extends upwardly adjacent the wall structure and is temporarily secured thereto, with the siding or the like then being placed at the outer side of the tool arm, and being supported at a predetermined level by a projection extending outwardly from a lower portion of the arm, so that the siding can then be nailed to the wall structure and the tool can ultimately be withdrawn from its position of reception between the siding and wall structure for use in similarly positioning and securing a next successive layer of siding, shingles, etc. to the structure. Preferably, two such tools are employed at horizontally spaced locations for supporting the siding or the like therebetween.

12 Claims, 6 Drawing Figures

APPLICATION OF SIDING, SHINGLES OR SHAKES TO A WALL STRUCTURE

BACKGROUND OF THE INVENTION

This invention relates to improved methods and apparatus for applying siding boards, shingles, shakes or other similar covering elements to the wall of a building.

In applying siding, shingles, or the like to a wall structure, it is frequently very difficult for a person or persons to accurately locate the siding board or the like and hold it in a precisely predetermined position while it is being nailed or otherwise secured to the wall. For example, in the case of horizontally elongated siding boards, it is necessary first to elevate the board to a predetermined level, and then hold it in a position in which its lower edge is exactly horizontal while it is nailed to the sheathing or studs of the wall. Positioning a board of this type is extremely difficult for one person working alone, and even when two persons are working together is considerably more difficult and time consuming than would be desired. Similar difficulties are encountered in attempting to accurately position a series of shingles or shakes in horizontally aligned relation, and to attach them to the wall in that condition.

U.S Pat. No. 3,904,184 shows a tool which is designed to assist in the application of wood siding or the like to a building, and which includes an upper member which is secured to the wall structure and a siding supporting arm which projects downwardly from the upper member to support the siding in a position between the arm and wall. The arm must be swung outwardly relative to the upper member of the tool to permit insertion of the siding behind the arm, with the latter being spring returned inwardly toward the wall structure to confine the siding in supported relation. This two piece pivotal arrangement must obviously be handled rather carefully in use in order to avoid damage to the tool, and in addition involves what would appear to be a rather inconvenient method of handling the siding in slipping it behind the tool or tools, assuring its proper support by the tools, and ultimately removing the tools after attachment of the siding to the wall.

SUMMARY OF THE INVENTION

The present invention provides an improved tool for the above discussed general purpose of mounting siding or the like on a wall, but which can be much simpler than the tool shown in the mentioned patent, and can be employed in a considerably simplified handling process. The present tool does not require use of two pivotally interconnected or spring urged parts, or any other similar mechanical movement, and can therefore be much simpler, less expensive, and less subject to derangement than the tool of the patent.

Structurally, a tool embodying the invention includes an arm which is received closely adjacent the wall structure, with the siding, shingles, or the like being supported at the outer side of the tool arm, that is, with the arm being received between the siding and the wall structure. A projection carried by a lower portion of the arm extends outwardly for supporting the siding or the like, and an upper portion of the arm extends upwardly above the siding for attachment by nails or otherwise to the sheathing or studs of the wall structure. Two such tools may support a length of the siding at horizontally spaced locations, and in a position in which the lower edge of the siding extends precisely horizontally. After the siding has been secured to the wall structure, the tool or tools can be detached from the wall and slipped out of their position of reception between the siding and the wall structure, for use in similarly locating a next successive covering element.

When the covering elements for the building are to be shingles, or shakes, an elongated board or other member may be positioned on the projections of a pair of tools, and the shingles or other covering elements can then be supported on the upper surface of that board, in exactly horizontal alignment, while being nailed to the wall.

BRIEF DESCRIPTION OF THE DRAWING

The above and other features and objects of the invention will be better understood from the following detailed description of the typical embodiments illustrated in the accompanying drawing in which.

DESCRIPTION OF THE PREFERRED EMBODIMENTS

Figure 1:
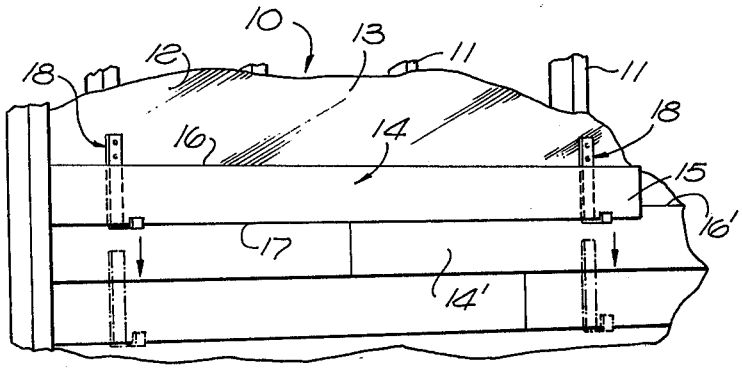
FIG. 1 is a fragmentary perspective view showing application of a siding board to a wall structure by tools embodying the invention.

FIG. 1 illustrates at 10 a vertical wall structure of a home or other building, typically including the usual series of spaced vertical wooden studs 11 carrying at their outer sides a layer of sheathing represented at 12 and having an outer vertical planar surface 13. Siding boards 14 are to be nailed to the sheathing 12 and/or studs 11, and may be formed of wood, hardboard, or any other desired material. Each length of siding 14 has its lower portion 15 overlapping the upper portion of the next lower strip of siding, in conventional manner, with the thickness of the siding boards progressively increasing from the upper horizontal edge 16 of the board to its lower overlapping horizontal edge 17.

Figure 2:
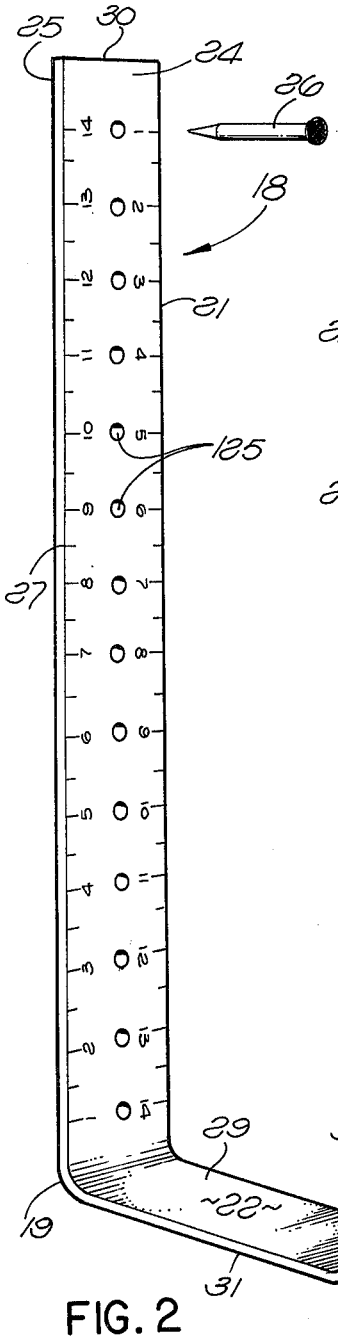
FIG. 2 is an enlarged perspective view of one of the tools.

For hanging a particular one of the siding boards 14, I utilize two preferably identical hanging tools 18 which embody the present invention, and one of which is illustrated in enlarged form in FIG. 2. As seen in that figure, each of these tools is desirably formed of a single piece of material, preferably an elongated strip of cadmium plated steel, chrome plated steel, stainless steel, or other material having sufficient stiffness to rigidly retain the shape illustrated in FIG. 2 and having corrosion resistance for durability. The strip of material from which part 18 is formed is bent at two locations 19 and 20 to form a first vertical flat arm 21, a projection 22 extending outwardly from the lower end of the arm, and a short lug 23 extending upwardly at the extremity of projection 22.

Arm 21 is defined at its opposite sides by two parallel planar front and rear surfaces 24 and 25, the latter of which abuts against and continuously engages the vertical surface of sheathing 12 of the wall structure. A series of evenly vertically spaced openings 125 extend through the material of arm 21, to pass a nail 26 through any one of these openings and into the sheathing or studs of the wall structure to suspend tool 18 therefrom. Two scales 27 and 28 extend vertically along the opposite side edges of arm 18, preferably being marked off in inches and half-inches, and with the apertures 125 desirably being formed at the various one inch locations along these scales. As illustrated in FIG. 2, scale 27 may commence at the bottom of arm 21, indicating distances above the level of horizontal upper surface 29 of projection 22, while scale 28 may commence at the upper end of the arm, indicating distances downwardly from the upper extremity 30 of the arm.

The horizontal upper surface 29 of projection 22 and a parallel horizontal undersurface 31 of that projection are perpendicular to the vertical front and rear surfaces 24 and 25 of upwardly projecting arm 21. The front and rear surfaces 32 of upwardly projecting lug 23 are parallel to one another and to surfaces 24 and 25 of arm 21, and are perpendicular to the top and bottom surfaces 29 and 31 of projection 22. An opening 33 may be formed in a central portion of lug 23, for a purpose which will be brought out in discussing the tool shown in FIG. 3.

In applying the siding board 14 of FIG. 1 to wall structure 10, the first step is to temporarily attach the two tools 18 to wall structure 10 in horizontally spaced relation as illustrated. Each of these tools is secured to the wall structure by driving a nail 26 through one of its upper openings 125, at a level high enough to be received above the upper edge 16 of the siding when the siding is supported on the two tools. Each of the tools may be located relative to the next lower layer of the siding 14' by locating a particular one of the markings of scale 27 or 28 directly opposite the upper edge 16' of that next lower siding board. For example, if each of the siding boards is to overlap the next board a distance of two inches, the edge 16' can be positioned directly opposite the two inch marking on scale 27 of FIG. 2.

After the tools 18 have been mounted on the wall as described, the siding board 14 is placed on the upper surfaces 29 of projections 22 of the tools, in a position of extension between the two tools as illustrated in FIG. 1, and the siding board is pushed rearwardly against the arms 21 of the tools to a position in which it is accurately located for nailing to the wall structure. A few nails are driven through the upper edge portion of the siding board into the wall structure to hold it in place, following which the nails which have theretofore secured tools 18 in place are removed and the tools are slipped downwardly between the siding and wall structure and to the broken line positions of FIG. 1, and thus removed from behind the siding. The nailing of board 17 to the wall structure can then be completed by application of further nails. After a series of siding boards have been applied in this manner at a particular level, the tools 18 are moved to a next higher level to similarly apply the next successive overlapping series of siding boards, until the entire wall structure has been covered in this manner.

Figure 3:
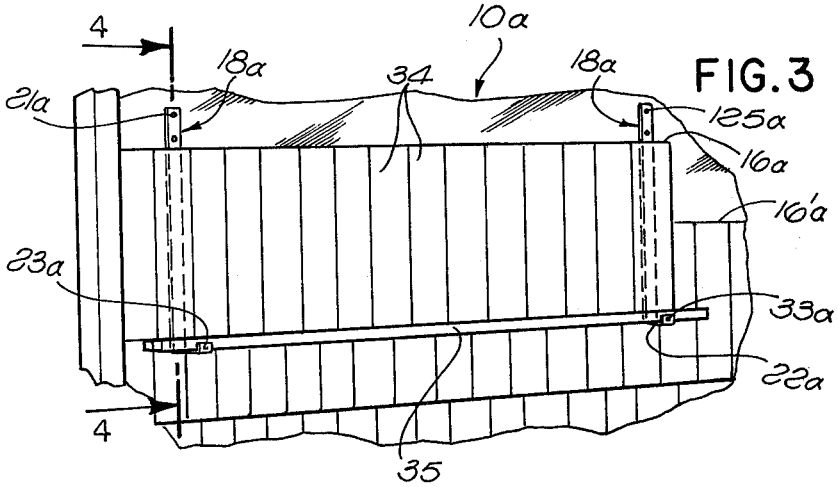
FIG. 3 is a view similar to FIG. 1, but showing use of tools embodying the invention in applying shingles or shakes to a wall structure.

FIG. 3 shows the manner in which a pair of tools **18*a* similar to the tools 18 of FIG. 1 can be employed for attaching a series of shingles or shakes 34 to a wall structure 10*a*. The tools 18*a* can be considered as identical with tools 18, except that the vertical arm portions 21*a* are longer, typically being 27 inches long in FIG. 3 and 15 inches long in FIG. 1. This increased length is desirable since the vertical dimension of the shingles or shakes is normally greater than the vertical height of siding boards as illustrated in FIG. 1**.

Figure 4:
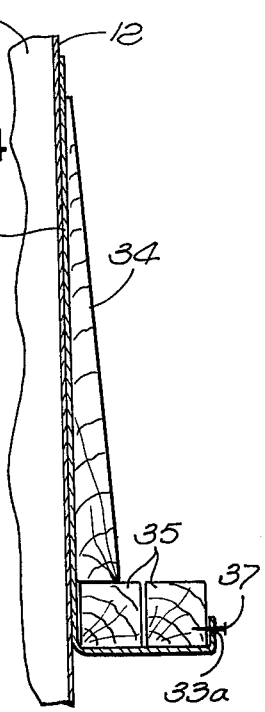
FIG. 4 is a vertical section taken on line 4—4 of FIG. 3.
Figure 5:
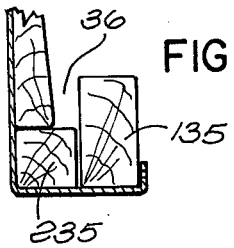
FIG. 5 and 6 are views similar to FIG. 4 but showing other arrangements for supporting the shingles or shakes from the tools.
Figure 6:
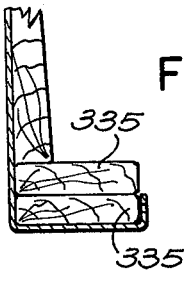

In using the FIG. 3 tools, they are first secured to wall structure **10*a* by nails driven through upper ones of the apertures 125*a* in arms 21*a* (at a level which will be above the upper edges 16*a* of the shingles), and with the two tools being laterally spaced as shown. The elevation of the tools is determined by positioning an appropriate one of the scale markings on arm 21*a* (markings corresponding to those of scales 27 and 28 of FIG. 2) directly opposite and in horizontal alignment with the upper edge 16'*a* of the next lower row of shingles (the row which is being overlapped). An elongated board 35 is then positioned in engagement with the upper surfaces of lower horizontal projections 22*a* of tools 18*a*, to extend horizontally between the two tools, so that the lower edges of the shingles or shakes 34 can rest on and be supported by an upper horizontal surface of board 35. This board 35 may be of uniform cross-section along its entire length, and of any convenient cross-sectional size and shape. For example, it is contemplated that a single board of nominal two inch by two inch cross-sectional shape can be employed, being received against the forward surfaces of the arms 21*a* of tools 18*a*. Alternatively, any of the arrangements shown in FIGS. 4, 5 and 6 can be employed. In FIG. 4, two boards 35 of nominal two inch by two inch cross-sectional shape and size are provided, with these boards being retained on the upper surfaces of projections 22*a* by upturned lugs 23*a* at the extremities of those projections. In FIG. 5, an outer board 135 of increased height and an inner board 235 of lesser height define together a recess 36 which confines the lower ends of the shakes 34 against outward movement away from arm 21*a* of the tool. Board 135 may typically be of nominal two inch by four inch cross-section, and board 235 may be of nominal two inch by two inch cross-section. In FIG. 6, two superimposed identical flat boards 335** are supported as shown, each typically being of nominal one inch by four inch cross-section.

After the tools **18*a* and boards 35, 135, 235 or 335 have been positioned as shown in FIG. 3, the shakes or shingles 34 are located on the upper surface or surfaces of the horizontal boards, being held in horizontal alignment thereby, and are then nailed to the wall structure. After each of the shingles or shakes has been at least temporarily held in place, the tools 18*a* can be detached from the wall structure and slid downwardly after the board or boards 35**, etc. have been removed, so that the tools and boards can be moved to a next successive location at which the process is repeated, to ultimately cover the entire wall structure in this manner.

If there happens to be a strong wind during use of the tools of FIG. 3, two nails 37 may be driven through the openings **33*a* in lugs 23*a* of the tools (corresponding to openings 33 of lugs 23 in FIG. 2), with the nails extending into one of the corresponding boards 35, 335, 135 or the like, to hold the supporting board or boards against displacement by the wind. Nails may similarly be driven through the opening 33 of the shorter FIG. 2** tool if a supporting board is for any reason used in conjunction therewith.

While certain specific embodiments of the present invention have been disclosed as typical, the invention is of course not limited to these particular forms, but rather is applicable broadly to all such variations as fall within the scope of the appended claims.

I claim:

1. The method of applying wall covering elements to a wall structure that comprises:

temporarily attaching at least one tool to the wall structure by a fastener engaging an upper portion of the tool, with said tool having an arm extending downwardly from the location of the fastener and adjacent the wall structure and having a projection which extends outwardly at a location spaced beneath said fastener a distance greater than the vertical dimension of said covering element;

supporting a wall covering element by said projection of the tool and at the outer side of said arm, with the arm received between the covering element and the wall structure and projecting upwardly beyond said covering element and with said fastener exposed above the covering element;

attaching the covering element to the wall structure;

acting against said exposed fastener above the covering element to disconnect the tool from the wall structure; and sliding the arm of the tool out from behind the covering element.

2. The method as recited in claim 1, including temporarily attaching two of said tools to the wall structure by fasteners at horizontally spaced locations; supporting a covering element or elements on and in front of said two tools at such spaced locations and with the fasteners exposed above said element or elements; attaching said element or elements to the wall structure; and ultimately acting against the fasteners to detach the tools and then sliding both of said tools out from behind the covering element or elements.

3. The method as recited in claim 1, including attaching two of said tools to the wall structure by fasteners at horizontally spaced locations; positioning a horizontally elongated member in a position of extension between the tools and support by their projections; supporting a plurality of covering elements on said elongated member with said arms of the tools received between the covering elements and wall structure and projecting upwardly above and being supported by the fasteners above the covering elements; securing the covering elements to the wall structure; removing said elongated member from said tools; acting against said fasteners to detach said tools from the wall structure; and sliding said tools out from behind the covering elements.

4. The method as recited in claim 1, in which said tool has an aperture projecting above the covering element; said fastener being a nail; said temporary attachment of the tool to the wall structure being effected by driving said nail through said aperture and into the wall structure; said tool being disconnected from the wall structure by withdrawing said nail therefrom.

5. The combination comprising:

a wall structure;

a wall covering element adjacent the wall structure;

a tool temporarily supporting said wall covering element and having an arm extending upwardly behind the covering element and between it and the wall structure;

said tool having a projection extending outwardly from a lower portion of said arm at a location beneath said covering element and supporting said element at a predetermined level;

said arm having an upper portion projecting upwardly beyond said covering element; and a fastener temporarily attaching said arm to the wall structure above the covering element and exposed for actuation to release the tool for sliding removal from behind the covering element.

6. The combination as recited in claim 5, including a lug extending upwardly at an outer end of said projection and retaining the supported element on said projection.

7. The combination as recited in claim 5, in which said fastener is a nail driven through an aperture in said arm and driven only partially into the wall structure with a portion of the nail projecting outwardly beyond the arm to facilitate removal of the nail from the wall structure.

8. The combination as recited in claim 7, in which said projection has a horizontal upper surface for supporting said covering element, there being a lug projecting upwardly from an outer end of said projection and above the level of said upper surface thereof to retain said supported element thereon, said arm containing a series of said apertures at vertically spaced locations through which nails can be driven to suspend the tool from a wall structure, and vertically spaced scale markings on said arm.

9. The combination as recited in claim 5, including two of said tools having projections supporting said elements at horizontally spaced locations and having arms which are received behind the covering element and are secured temporarily by fasteners to the wall structure upwardly beyond the covering element.

10. The combination are recited in claim 5, including two of said tools at horizontally spaced locations, an elongated horizontal member supported at spaced locations by said projections of the two tools, there being a series of said covering elements supported on said elongated member in horizontally aligned relation, each of said tools having one of said arms received behind one of said elements and secured to said wall structure by a fastener upwardly beyond the element.

11. The combination comprising:

two similar tools to be secured temporarily to a wall structure at horizontally spaced locations and each having an arm adapted to extend upwardly adjacent the wall structure and between it and a covering element;

each of said tools having a projection extending outwardly from a lower portion of said arm to be received beneath a covering element;

an elongated member to extend horizontally between said tools and be supported by said projections at spaced locations and adapted to support covering elements;

each of said tool arms having an upper portion adapted to project upwardly beyond a supported covering element and containing an aperture for receiving a fastener above the covering element to temporarily secure the tools and supported horizontal member to the wall structure;

each of said arms being constructed to be slidable from between the wall structure and covering element after attachment of the latter to the wall structure.

12. The combination as recited in claim 11, in which each of said arms of the two tools has a series of said nail apertures spaced vertically apart, and has a series of vertically spaced scale markings.

* * * * *